US006361336B1

(12) United States Patent
Zhao et al.

(10) Patent No.: US 6,361,336 B1
(45) Date of Patent: Mar. 26, 2002

(54) ELECTRICAL COUPLING DEVICE FOR ALIGNING AND INTERENGAGING A PLURALITY OF MULTI-PIN CONNECTORS

(75) Inventors: Weiping Zhao; Daniel E. Boileau, both of Canton, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 0 days.

(21) Appl. No.: 09/785,837

(22) Filed: Feb. 16, 2001

(51) Int. Cl.[7] ..... H01R 13/62
(52) U.S. Cl. ..... 439/157; 439/341
(58) Field of Search ..... 439/152, 153, 439/157, 341, 376

(56) References Cited

U.S. PATENT DOCUMENTS

| | | | | |
|---|---|---|---|---|
| 3,836,885 A | | 9/1974 | Larsile | 439/341 |
| 5,032,087 A | | 7/1991 | Koiner et al. | 439/341 |
| 5,431,573 A | * | 7/1995 | Endo et al. | 439/157 |
| 5,569,040 A | * | 10/1996 | Sumida | 439/157 |
| 5,711,682 A | | 1/1998 | Maejima | 439/157 |
| 5,873,745 A | | 2/1999 | Duclos et al. | 439/157 |
| 5,980,283 A | | 11/1999 | Okabe | 439/157 |
| 6,019,620 A | | 2/2000 | Kodama et al. | 439/157 |
| 6,056,582 A | | 5/2000 | Okabe | 439/372 |
| 6,065,982 A | | 5/2000 | Okabe | 439/157 |

* cited by examiner

*Primary Examiner*—Tulsidas Patel
(74) *Attorney, Agent, or Firm*—Tracey D. Beiriger

(57) ABSTRACT

An electrical coupling device for a vehicle that includes a tub having side ends defining an upwardly facing perimeter edge surrounding an open interior. A plurality of female connectors are mounted within the tub open interior and arranged in axially extending and predetermined spaced apart fashion. Electrical components extend from the top surface of an electrical center and electrically communicate with male connectors constructed to the bottom surface of the electrical center. A lever pivotally engages with the tub and is rotated from a first disengaged position over and across the top surface of the electrical center to a second and electrically engaged position proximate the first end, and so that each of the male connectors is drawn in successive and engaging electrical contact, and with a significant minimization of mating force with the female connectors.

14 Claims, 7 Drawing Sheets

124
131
126
168
128
130
134
22
90
138
142
132
16
140
14
162
36
84
86
80
136
164
24
114
112
82
34
160
26
32
170
178
118
20
174
180
18
122
120
158
176
172
88
116
166
78
12
10

ELECTRICAL COUPLING DEVICE FOR ALIGNING AND INTERENGAGING A PLURALITY OF MULTI-PIN CONNECTORS

BACKGROUND OF THE INVENTION

1. Field of the Invention

The present invention relates generally to quick connect devices for engaging multiple female connectors in a bussed electrical center system. A female connector is a plastic housing containing female terminal(s). More specifically, the present invention relates to an under the hood mounted bussed electrical center (UHBEC) and any other electrical distribution boxes employing sequential and aligning engagement of individual pluralities of female terminals, each associating with a specified female connector, with associated and floating female connectors, corresponding to interengaging male connectors containing many male terminals or blades. Male connectors have chamfered front openings to catch and align the floating female connectors. The contact points of female terminals are arranged at different positions inside female connectors. Upwardly facing and chamfered pockets in a tub align male connectors. The electrical center is seated and aligned to the tub before actuating the lever. In this fashion, each sub-plurality of male terminals or blades can be engaged by pivotal actuation of a lever handle associated with more than one male connector, upon which are mounted the male terminals, and the tub associated with the floating female connectors of the UHBEC. The male terminals are protected from damage by any other objects by arranging the terminal tips much lower than the male connector edges and the two middle projections.

2. Description of the Prior Art

The prior art is well documented with various types of electrical coupling devices for engaging a plurality of female terminals, corresponding to a female connector, with a male connector. A male connector is a plastic housing containing male terminals or blades. Such "bussed" electrical connector centers are particularly well suited for installation within a vehicle, such as under the hood and under the instrument panel.

One known type of bussed electrical center teaches a bracket to which are mounted the male connectors. Bolts are utilized to drive the bracket down onto a base surface incorporating associated female connectors. The drawbacks associated with this bussed electrical center include tendency of cross threading and over/under torquing the fasteners of the connector bracket, resulting in an incomplete electrical connection and the possibility of damage to the connectors due to significant and uneven forces applied during engagement of male terminals with the female receiving apertures of female terminals. Further, this type of system requires three bolt-driving operations for a three-connector system which adds costs and creates a warranty issues. Additionally, it has been determined that the instantaneous application of an engaging force to a complete plurality of terminals tends to contribute to the damage and/or incomplete connections as indicated above.

An additional example of an electrical coupling device is disclosed in U.S. Pat. No. 5,032,087, issued to Koiner et al., and which includes a contact strip firmly secured to the frame of the unit and a corresponding socket strip lodged in a housing. The socket strip housing is fitted to the frame by a pivot pin arranged at one end of the housing and which also includes a slide groove in at least one lateral longitudinal wall. The socket strip housing is pivoted by actuation of a lever, with its contacts locked to the contact strip, and upon displacing a sliding block in the slide groove. It is further worth noting that Koiner discloses only a single female connector having a socket strip, wherein the connector forms a pivoted portion of the assembly and the connector and contact strip do not float.

Another example of a lever engaged connector is illustrated in U.S. Pat. No. 6,065,982, issued to Okabe, and in which a lever is rotatably held between sidewalls of a connector body and inner walls of a hood. The connector includes a pair of lever walls for regulating the bending of the cover members and protrusions which extend from the lever walls on one side. When the connector body is fitted in the hood, the lever walls engage with the hood. Again, It is further worth noting that Okabe discloses only a single female connector and that the connector forms a parallel moving portion of the assembly.

U.S. Pat. No. 5,711,682, issued to Maejima, teaches an electrical connector requiring a low insertion force and including a first connector housing for retaining a first connector element, a second connector housing for retaining a second connector element to be engaged with the first connector element and an operating lever having at least one hook part arranged at an end thereof. The first connector housing has at least one holder for engaging with the hook part to thereby rotatably support the operating lever. The second connector housing includes a sidewall provided with a pin protruding therefrom and the operating lever further includes a slit for slidably engaging with the pin. Additional lever operated connectors are set forth, respectively, in U.S. Pat. No. 3,836,885, issued to Larsile, and U.S. Pat. No. 5,873,745, issued to Duclos et al., and illustrating first unlocked and second rotating and lock positions of a lever actuated housing upon a base surface. It is further worth noting that Okabe, Maejima, and Duclos Koiner disclose only that all female and male terminals inside their connectors engage at same time, and therefore, all terminals reach peak engaging force at the same time. The total connector engaging force is much higher than if the peak engaging forces are diversed. The total connector mating force reduction solely relies on the length of the pivotal arm.

SUMMARY OF THE PRESENT INVENTION

The present invention discloses an electrical coupling device, incorporating a lever engagement mechanism, and which enables individual and progressive engagement of a plurality of individual male connectors with their corresponding female connector counterparts. The electrical coupling device of the present invention is further an improvement over the prior art in that it enables specifically aligned, diversed terminal peak engaging forces, and mating connection of the multiple electrical connectors with a significant decrease in mating forces, and which would otherwise damage the interengaging connector terminals and avoids using any bolt systems which cause cross threading, or over or under torquing fasteners.

A tub has a base, first and second sides, a first end and a second end which define an upwardly facing perimeter edge surrounding an open interior. A plurality of first, second and third female connectors are mounted upon the base within the open interior and are arranged in an axially extending and predetermined spaced apart fashion. First, second and third bundles of wires communicating with the first, second, and third connectors, respectively, and extending from selected locations of the tub.

A bussed electrical center has a top surface, a bottom surface, first and second sides, a first end and a second end.

The sides and ends of the electrical center defining a downwardly faced perimeter edge and a plurality of first, second, and third male connectors are mounted to the bottom surface and arranged in an axially extending and predetermined spaced apart fashion. A plurality of electrical components extend from the top surface of the electrical center and electrically communicating with the male connectors.

Arcuately shaped recesses are defined within and along the first end of the tub, corresponding with the upwardly facing perimeter edge. The bussed electrical center further includes a projecting and laterally extending pin along the first end which seats within the arcuate recess to pivotally associate the bussed electrical center with the tub. A lever pivotally engages the tub proximate the second end and the upwardly facing perimeter edge. Engagement projections extend in inwardly and opposing fashion on opposite sides of interconnecting legs of the lever and seat within aligning and engaging grooves defined in the downwardly facing perimeter edge of the electrical center. The bussed electrical center includes two arcuately shaped bumps near the extending pin corresponding to two small pockets near arcuately shaped recesses along first end of the tub. The bussed electrical center is aligned to the tub by properly mating the extending pin to the arcuately shaped recesses, the two bumps to the two small pockets, and the lever engagement projections to engaging grooves. The lever is rotated from a first disengaged position, over and across the top surface of the electrical center, and to a second and electrically engaged position proximate the first ends of both the tub and electrical center.

In this fashion, each of the male connectors are drawn, upon the actuation of said lever and the resulting downward pivoting of the electrical center, in successive and engaging electrical contact against said female connectors. To further facilitate accurate and aligning engagement of the connectors, the female connectors are further seated, in floating fashion, within individual and axially extending pockets defined within the tub interior. The successive sequence of mating male and female terminals diverses the terminal peak engaging forces. Further more, six rows of female terminals parallel with the side of the tub are seated inside female connectors. The vertical positions of the contact point in the middle two rows terminals are different (about 1.00 mm) from the outside four rows. Terminals inside the two rows reach their peak engaging force at different times than the outside four row terminals. Combining mating sequence and different vertical positions of terminal contact points, the diversion of peak engaging forces is maximized, which reduces the overall mating force. Upwardly facing and chamfered edges of the pockets aligningly engage with associated and likewise projecting edges surrounding each of the male connectors. Downwardly facing and chamfered inner projection edges of male connectors catch and align the female connectors. Combined with the floating range of realignment permitted of the female connectors, these edges prevent inadvertent damage to the connector portions, male terminals, and female terminals during the mating engagement. The floating and alignment features make it possible to accept multiple independent connectors with varying manufacturing process tolerance requirements because of the de-coupling of the dependency of the three connectors.

Other features include the male terminal protection from accidentally scooping or impacting other objects.

Additional features include the provision of a cover that is hingedly secured to a selected end of the bussed electrical center and over and across which the lever may be actuated without contacting the cover. Also, a stamping mount bracket is configured to being secured to a desired location in the vehicle engine compartment, such as a fender shroud, and includes posts which seat within corresponding vertical slots formed in the tub sides to secure the device in place.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
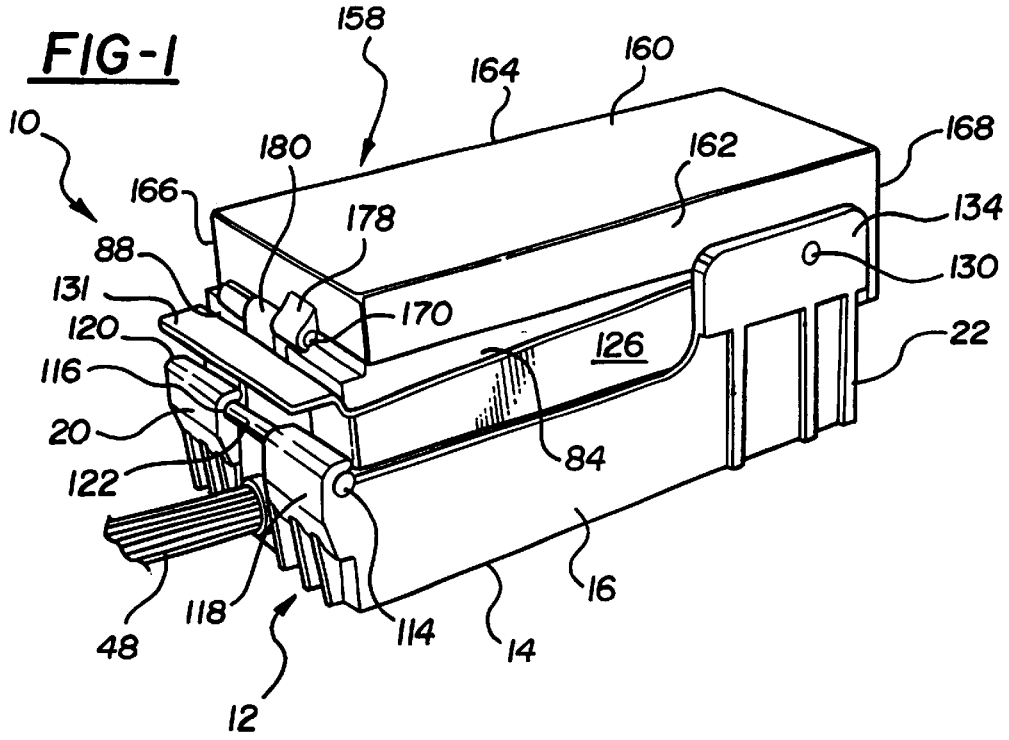
FIG. 1 is a first perspective and assembled view of the electrical coupling device according to the present invention.
Figure 2:
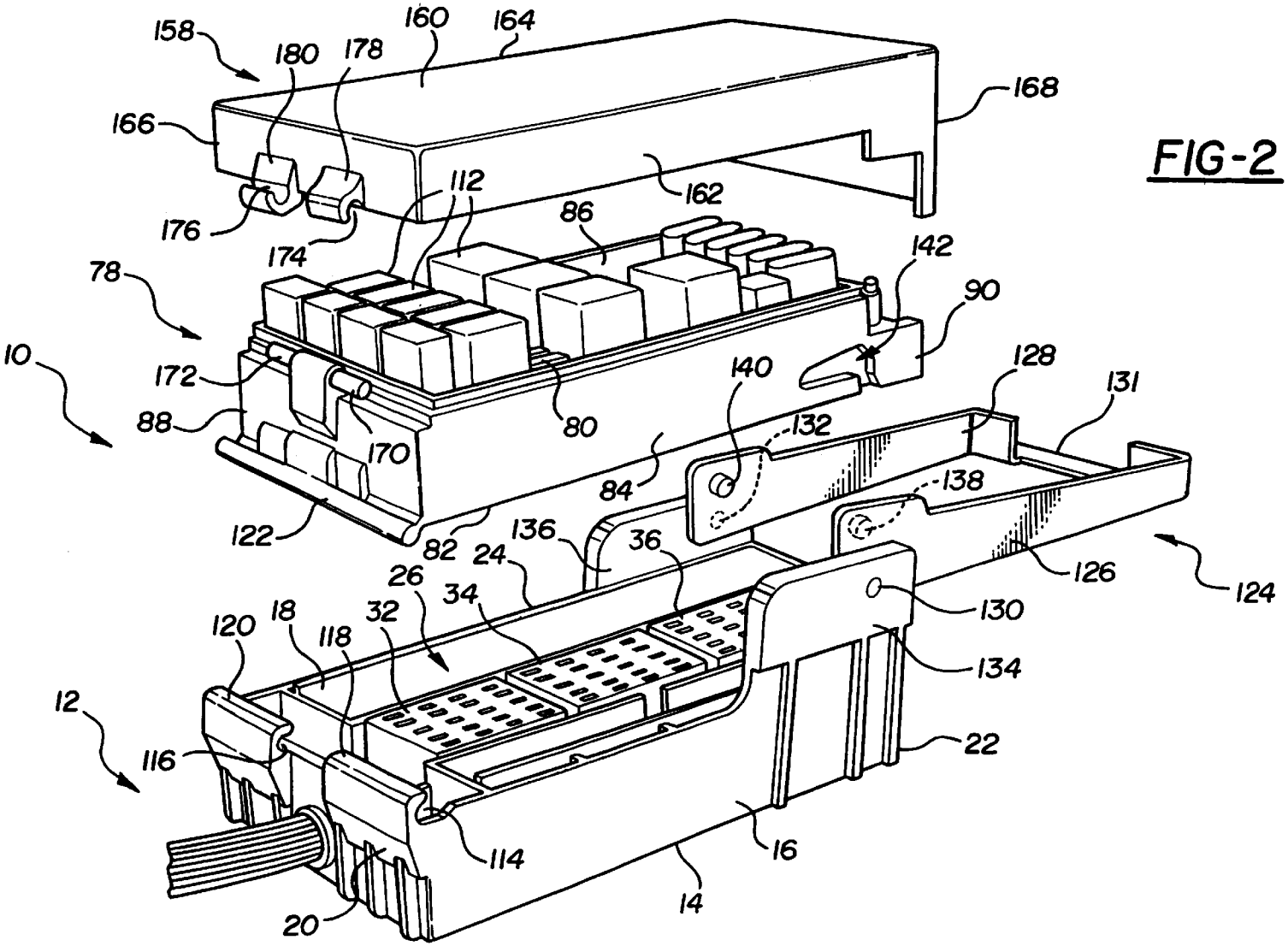
FIG. 2 is an exploded view of the electrical coupling device according to the present invention and illustrating the tub, bussed electrical center, lever and cover components.

Referring now to FIGS. 1 and 2, an electrical coupling device is illustrated at 10 according to the present invention.

As previously explained, the coupling device 10 incorporates a lever engagement mechanism which enables individual and progressive engagement of a plurality of individual male connectors with their corresponding female connector counterparts. The electrical coupling device of the present invention is further an improvement over the prior art in that it enables specifically aligned and mating connection of such a plurality of electrical connectors, with significant decrease in the mating forces associated with such electrical engagement and which would otherwise damage the interengaging connector terminals and avoids using any bolt systems which cause cross threading, or over or under torquing fasteners.

Figure 3:
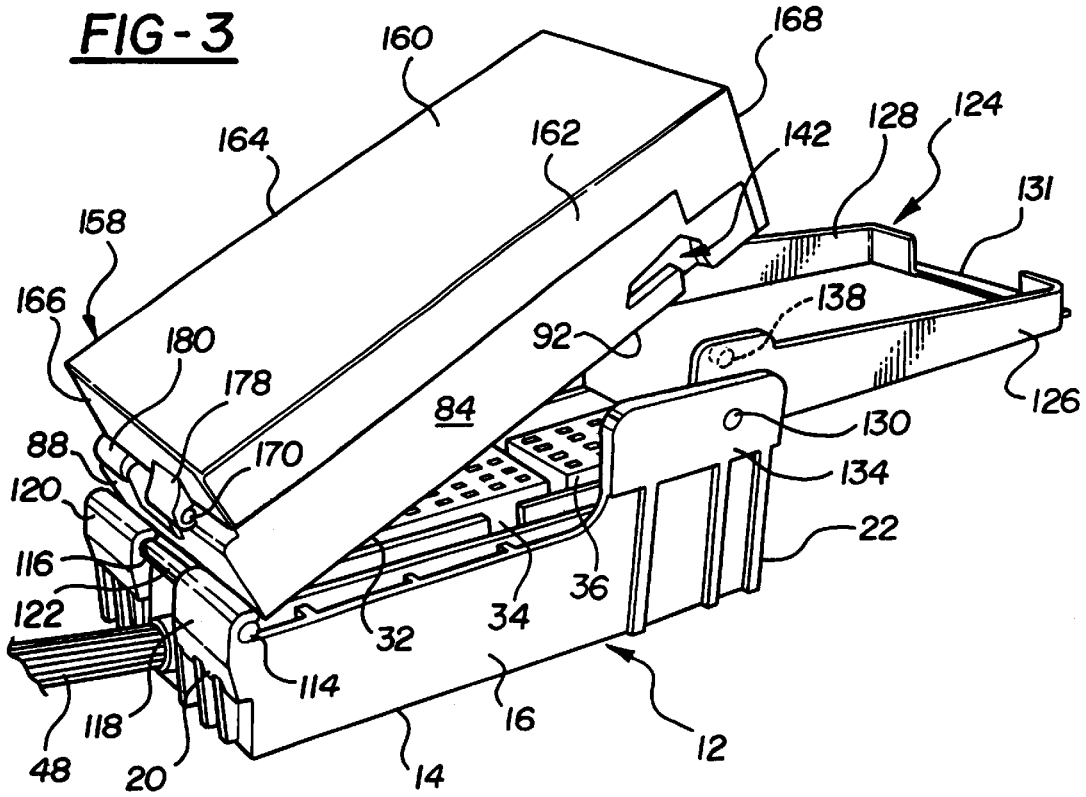
FIG. 3 is a perspective view similar to that illustrated in FIG. 1 and further showing the bussed electrical center in a partially and pivotally engaged configuration relative to the tub according to the present invention.
Figure 5:
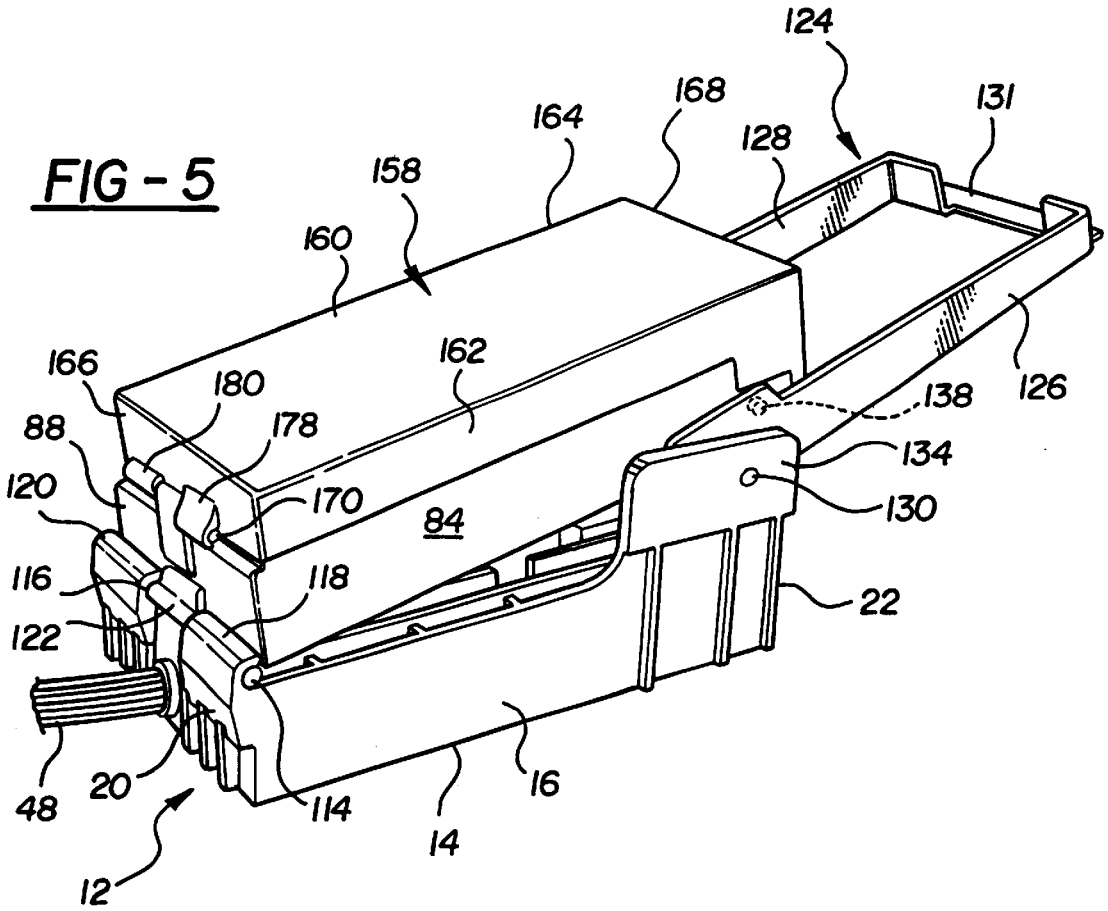
FIG. 5 is a further perspective view of the bussed electrical center seated at both first and second ends with the tub and prior to actuated engagement of the lever.
Figure 6:
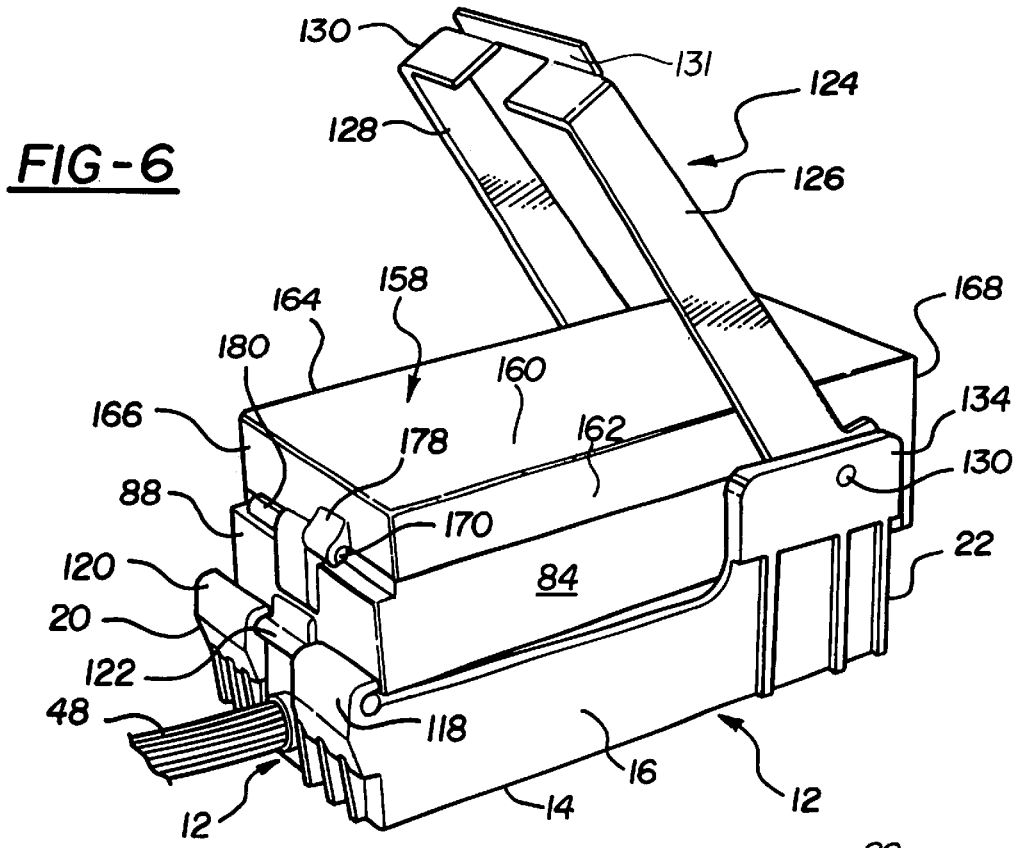
FIG. 6 is a yet further perspective view of the electrical coupling device and showing the lever in a semi-engaged and actuated position for progressively and matingly engaging the male connectors associated with the bussed electrical center with the female connectors associated with the tub.

As is additionally illustrated in FIGS. 3, 5 and 6, the electrical connector device includes a tub 12, constructed of a durable and substantially electrically insulating material such as a durable plastic, and having a substantially three dimensional and elongated rectangular shape with a base 14, a first extending side 16, a second extending side 18, a first end 20 and a second end 22, which collectively define an upwardly facing perimeter edge 24 surrounding an open interior 26. As most clearly illustrated in FIG. 7, the open interior 26 of the tub is configured with inner and parallel extending partition walls, 28 and 30, which extend in inwardly spaced and parallel fashion relative to the side walls 16 and 18 and which define an inner boundary for receiving a plurality of first 32, second 34 and third 36 female connectors in an axially extending and spaced apart fashion. The connectors 32, 34 and 36 each include a plurality of individual terminal insertion slots, see at 38 for selected female connector 36.

Figure 9:
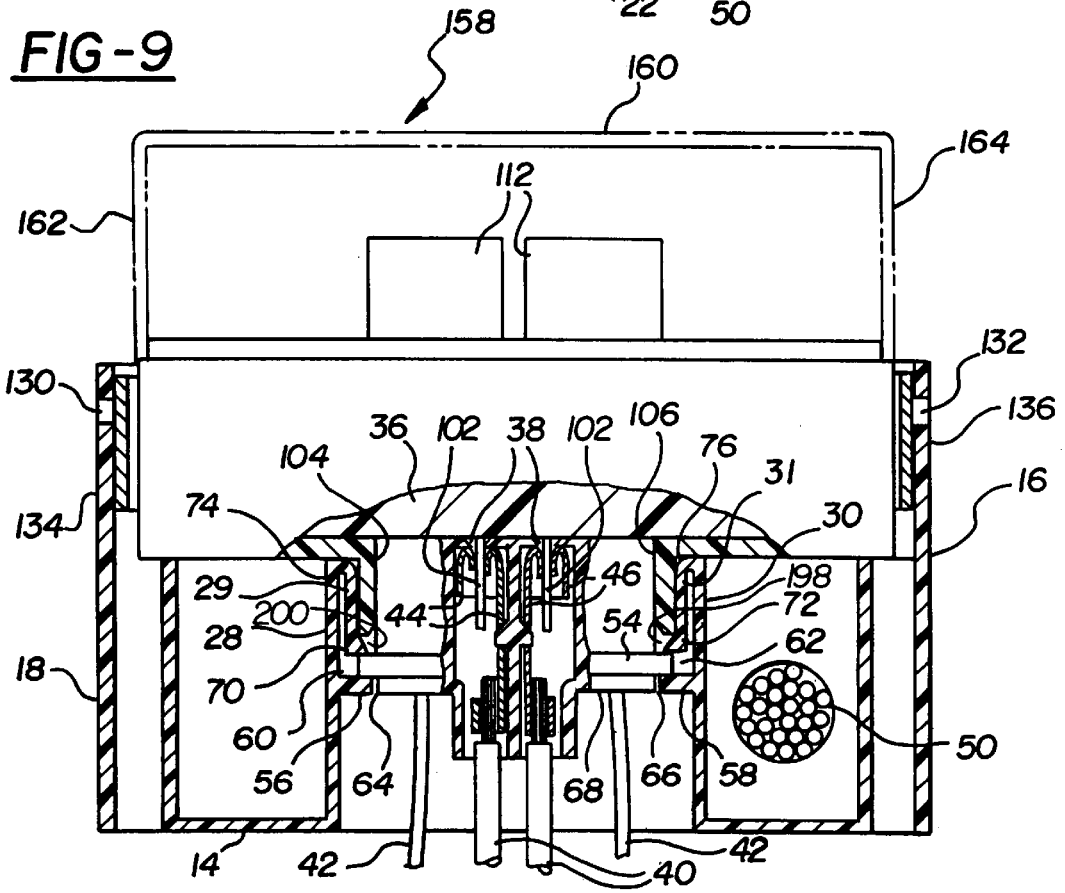
FIG. 9 is a cutaway taken along line 9—9 of FIG. 8 and illustrates the floating arrangement of the female connectors within associated pockets defined in the tub and further showing the chamfered upper edges for aligning and matingly engaging the male connectors.

Referring also to the cutaway view of FIG. 9, wires 40 and 42 extend communicably from interiorly configured female terminals 44 and 46 within the associated female connectors 32, 34 and 36. In all, first 48, second 50 and third 52 bundles of wires are communicated, respectively, with the first 32, second 34 and third 36 connectors, and extend from selected locations of the tub 12.

Figure 10:
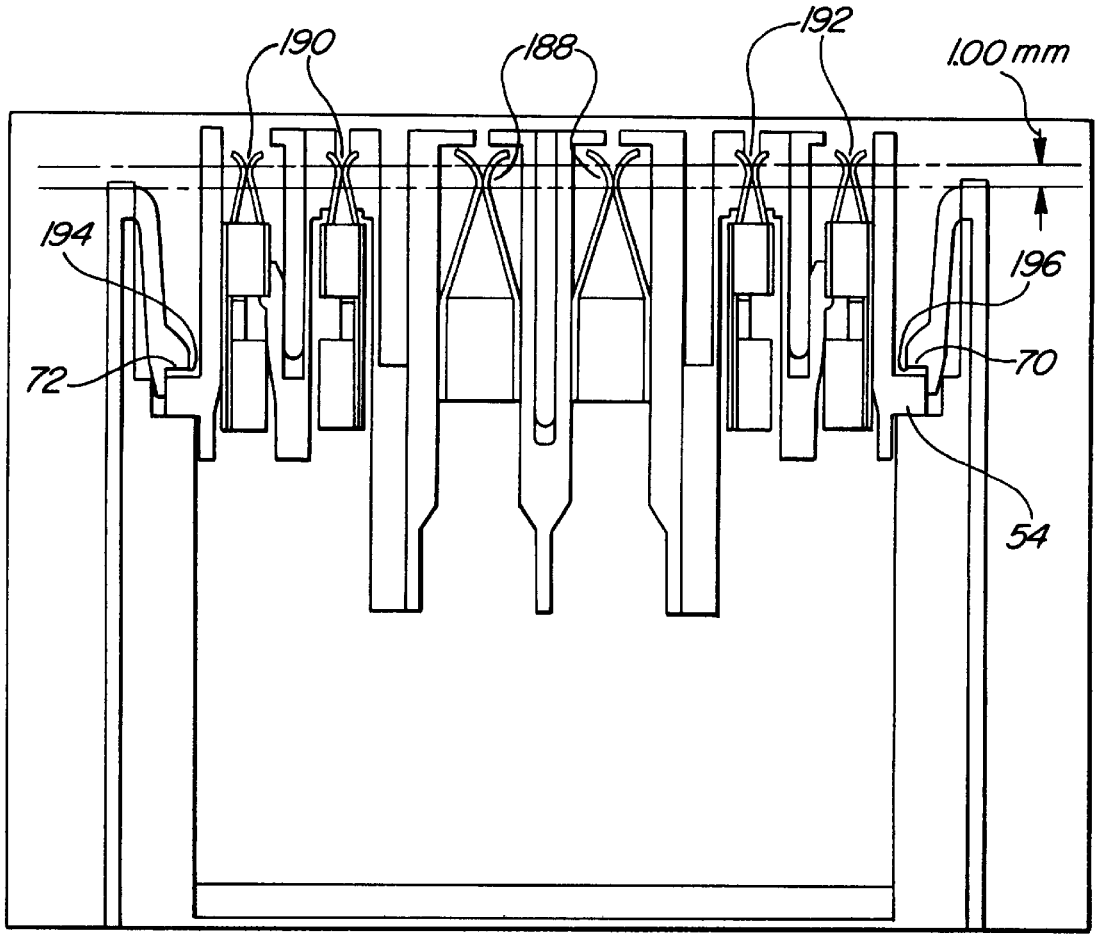
FIG. 10 is a cutaway view of a female connector wherein the positions of the female terminal contact points of the inside two rows are different from the outside four rows.

Referring also to the cutaway view of FIG. 10, the vertical positions of terminal contact points 188 in the middle two rows are different (about 1.00 mm) from the contact points 190 and 192 of the outside four rows. Terminals inside the two rows reach their peak engage force at different time from those of the outside four rows.

Figure 7:
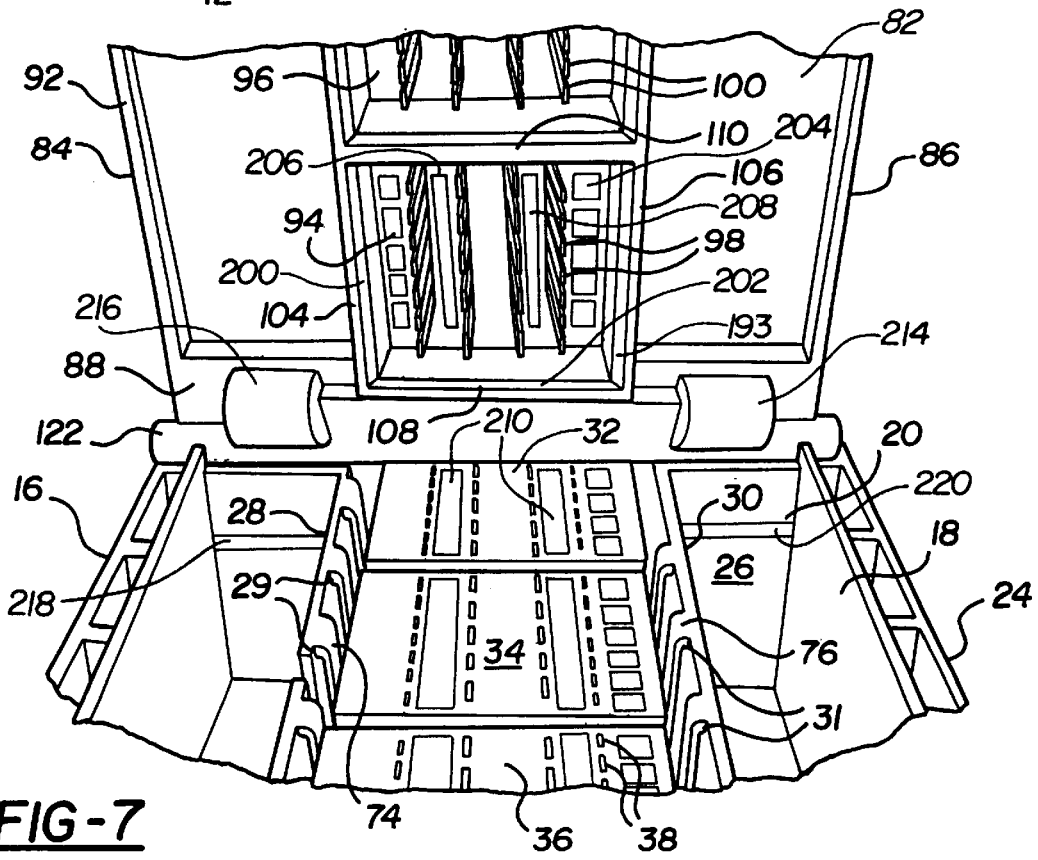
FIG. 7 is a rotated view in section of the electrical coupling device, as otherwise substantially illustrated in FIG. 3, and further showing the male terminals of the male connectors in pivotally arrayed and pre-engaged fashion relative to the female connectors.
Figure 8:
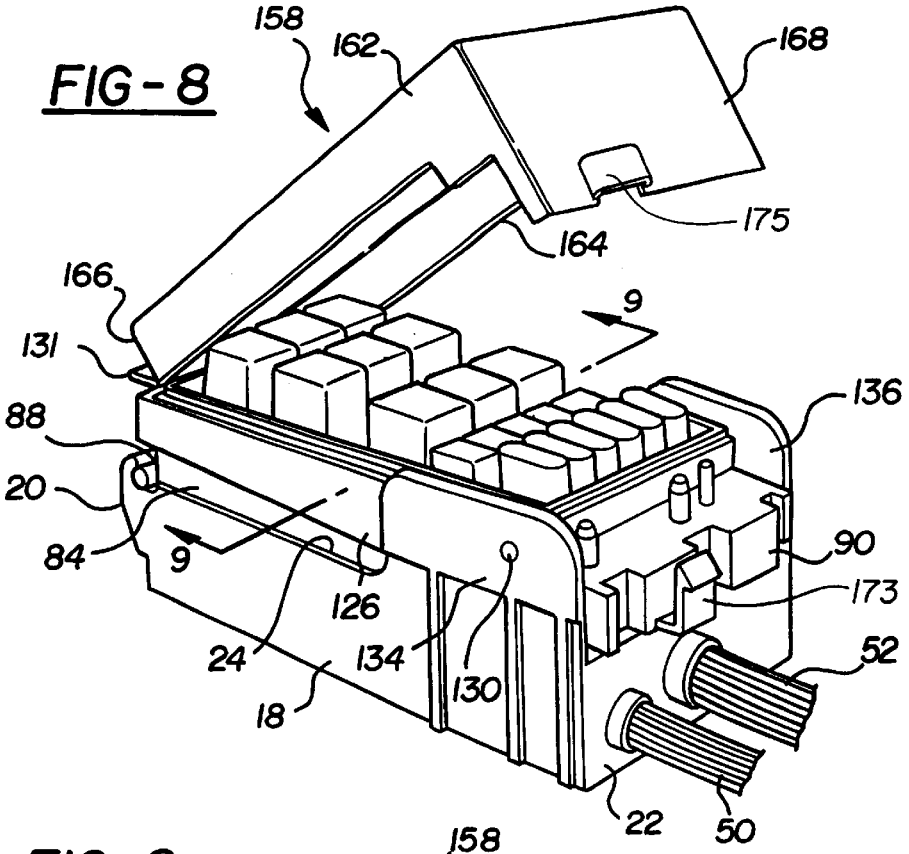
FIG. 8 is an installed view in perspective showing the lever fully engaging the bussed electrical center to the tub component of the coupling device and with the cover member partially and pivotally removed from the electrical center to reveal the electrical components.

As will also be subsequently discussed in additional detail, the female connectors 32, 34 and 36 are further mounted in floating fashion, preferably along first, second and third (x,y,z) axes within the individual and axially extending pockets defined within the tub interior 26 and specifically between the inner extending partition walls 28 and 30. As also illustrated in FIG. 7, inward projections (locking fingers) 29 and 31, associated with the walls 28 and 30, respectively, positionally locate and generally restrain, in the axial extending direction, each of the female connectors 32, 34 and 36. Spacings 194 and 196 are established between the surface 54 and the retaining edges 70 and 72 to regulate the degree of vertical floating movement (z-axis) permitted by the female connector.

Specifically, and referring again to FIG. 9, the side cutaway view of the third connector 36 further illustrates a base surface 54 and which seats upon inwardly horizontally extending and ledge supported surfaces 56 and 58 extending, respectively, from the partition walls 28 and 30. A spacing (see at 60 and 62) is established between the surface 54 and the partition sidewalls 28 and 30. An additional spacing (see at 64 and 66) also is shown between a lower arranged and additional shoulder support 68 and to regulate the degree of floating movement (y-axis) allocated the female connectors. It is understood that similar constructions are arranged along the section perpendicular to this cutaway view to regulate the degree of floating movement (x-axis) allocated the female connectors although it is not illustrated in any figures. Although not clearly illustrated from the view evident of FIG. 9, it is understood that the range of floating movement permitted the female connectors 32, 34, and 36 may adjusted to adapt to a specific application and further that the female connectors may be movable to a degree, in one example, of 2 mm along an x-axis direction, 1 mm along a y-axis direction, and 0.6 mm along a z-axis direction.

The partition walls 28 and 30 include an inwardly angled retaining edge, see at 70 and 72 and at the end of the inward projections 29 and 31, and which prevent the associated female connector, such as again at 36, from accidentally disengaging from within its pocket. The upper end boundary between the inward projections 29 and 31 and the associated side walls 28 and 30 of the pockets are further defined by an upwardly facing and chamfered edge, see at 74 and 76, and which, as will be further detailed below, positionally align and matingly engage with associated and likewise projecting edges surrounding each of a plurality of male connectors and, combined with the floating range of realignment permitted of the female connectors, prevent inadvertent damage to the connector portions during the mating engagement.

A bussed electrical center 78 is provided and, similar to the tub 12, is constructed of a durable plasticized material or other suitable material. The bussed electrical center 78, commercially also designated as an Under Hood Bussed Electrical Center (or UHBEC) and other under instrument panel BEC includes a top surface 80, a bottom surface 82, a first elongate and extending side 84, a second elongate and extending side 86, a first end 88 and a second end 90. The sides 84 and 86 and ends 88 and 90 of the electrical center 78 define, collectively, a downwardly faced perimeter edge 92 (see FIG. 7). A plurality of first, second and third male connectors are constructed (mounted) to the bottom surface 82 and arranged in an axially extending and predetermined spaced apart fashion in similar fashion to the female connectors 32, 34 and 36. The male connectors are substantially obscured throughout the several views however, and as is best illustrated again in FIG. 7, the first and second male connectors are illustrated at 94 and 96, respectively, and it is understood that the third such male connector is located in a suitably and axially spaced position so that it arrays over the corresponding third female connector 36.

Referring still to FIG. 7, the individual male connectors (again at 94 and 96) are each constituted by a plurality of individual and positive engaging male terminals or blades (see at 98 and 100, respectively) and which insert within associated and mating engagement with the female connectors 32, 34 and 36, see in particular terminals 102 of the third male connector (not shown) and which are installed between the female terminal clips 44 and 46. Each male connector further includes a downwardly projecting edge which, upon subsequent mating with its associated female connector, is positionally located between the chamfered edges of the female receiving pocket. As illustrated in FIG. 7, downwardly projecting and axially extending edges 104 and 106 are intersected by cross extending edges 108, 110, et. seq., and which define the individual male pockets. Four inner chamfered edges 198, 200, 202 and 204 form an inner tapered shape front opening. As is further shown in FIG. 9, the side extending edges 104 and 106 are again shown locatingly aligned between the chamfered edges 74 and 76. The inner chamfered edges 198, 200, 202, and 204 catch the female connector and align the floating female connector to the male terminals and therefore the male connector is matingly and electrically secured to their respective female connector. Terminals along the first to second end reach their peak forces at different times because the male and female connectors are mated angularly. Terminals along the same line parallel to extending pin 122 reach their peak forces at different times also because the vertical positions of their contact points 188 (the middle two terminals) are different from 190 and 192 of the outside four rows of terminals. All three female connectors are mated in same fashion but at different times. A plurality of electrical components 112 extend from the top surface 86 of the electrical center (UHBEC) 78 and electrically communicate with the male connectors 94, 96, et. seq.

Figure 11:
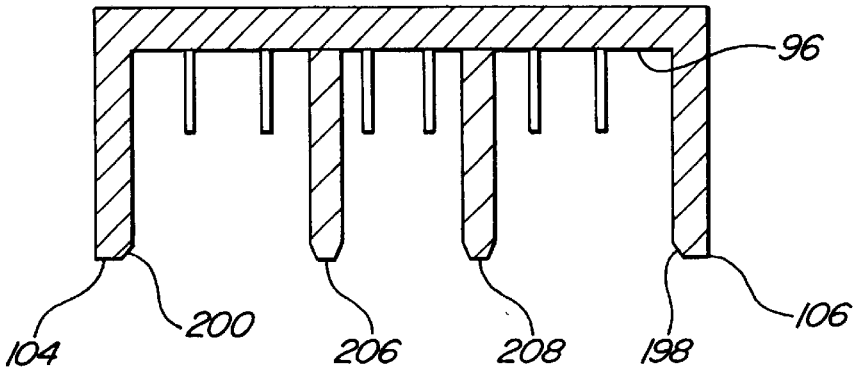
FIG. 11 is a cutaway view of a male connector wherein the tips of the male terminals are much lower than the middle two projections and the projection edges of the male connector.

In addition, FIG. 7 and FIG. 11 show two projections 206 and 208 between two rows of terminals. The tips of the male terminals are much lower than projections 206 and 208 and male connector edges 104 and 106. With this configuration, the male terminals are protected from damage due to accidental impact by other objects. Two slots 210 and 212 on each connector are provided to accept projections 206 and 208 when male and female connectors are fully mated. The bussed electrical center includes two arcuately shaped bumps 214 and 216 near the extending pin corresponding to two small pockets 218 and 220 near arcuately shaped recesses along first end of tub. To facilitate pivotal securing of the UHBEC 78 to the tub 12, and as an initial step towards mating engagement of the male connectors to the female connectors, arcuately shaped recesses 114 and 116 are defined within and along the first end 20 of the tub 12, corresponding with the upwardly facing perimeter edge 24. The recesses 114 and 116 are established by hinge supports 118 and 120 and which establish the recesses 114 and 116 in laterally extending and inwardly facing manner. The bussed electrical center 78 further includes a projecting and laterally extending pin 122 extending along its corresponding first end 88 and which seats within the arcuate recesses 114 and 116 to pivotally associate the bussed electrical center 78 with the tub 12 at their corresponding first ends.

A lever 124 is provided having a generally "U" shaped configuration and including first 126 and second 128 legs and a centrally extending and interconnecting member 131. First 130 and second 132 pivot projections extending in outwardly and opposite fashion from selected and aligning locations of the first 126 and second 128 lever legs and are seated within correspondingly aligning apertures 130 and 132 defined within the extending sides 16 and 18 of the tub 12 proximate the second end 22 and the upwardly facing perimeter edge 24. To facilitate the rotatable engagement of the lever 124 to the tub 12, upward projections 134 and 136 are configured, respectively, on the first 16 and second 18 sides of the tub 12 and to space the apertures 130 and 132 in a desired upward direction.

First 138 and second 140 engagement projections extend in inwardly and opposing fashion from further selected and aligning locations (typically upwardly spaced) of the first 126 and second 128 lever legs. First and second engaging grooves, configured to extend upward and successively inward, are defined in the downwardly facing perimeter edge 92 of the bussed electrical center 78, along its sides 84 and 86 and proximate its second end 90. The first engagement groove 142 is illustrated in FIGS. 2, 3 and particularly in enlarged section in FIG. 4. For purposes of ease of illustration, the corresponding second groove is not shown however it is understood that it is configured in identical and mirroring fashion within the second side 86 of the UHBEC 78, proximate the second end 90, and that it is engaged by corresponding engagement projection 140 extending inwardly from second leg 128 of "U" shaped lever 124.

Figure 4:
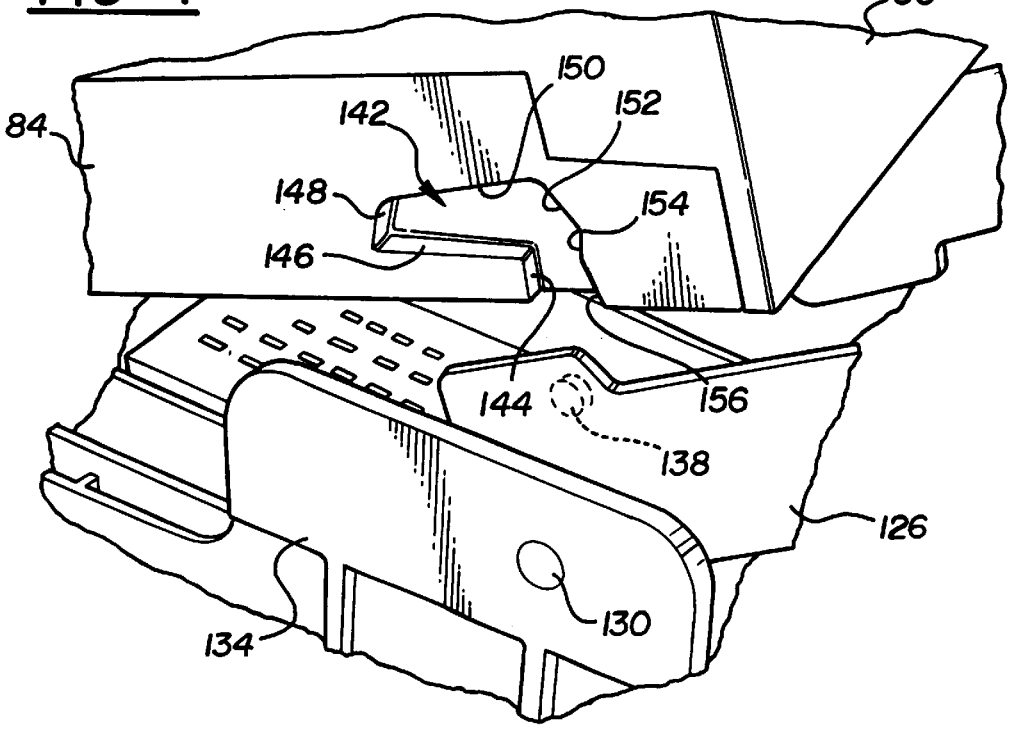
FIG. 4 is an enlarged sectional view, also illustrated in FIG. 3, of the seating configuration of the inwardly directed engagement projections of the lever with the engaging grooves formed in the tub.

Referring again to the enlarged section of FIG. 4, the first engagement groove 142 is again shown and includes a unique interconnection of interiorly facing surfaces 144, 146, 148, 150, 152, 154 and 156 and which, in combination, define the generally upward and successive inward travel of the engagement projections 138 and 140 as the lever 124 travels from the disengaged to the pivoted and matingly engaged positions. It is this unique configuration of the engagement grooves which, in part, provides the desired individual and successive engagement of the male connectors to their corresponding female connectors of the coupling device 10. As illustrated in FIGS. 3, 5 and 7, the bussed electrical center 78 is aligned to the tub 12 (see FIG. 5) by properly seating the extending pin 122 to arcuately shaped recesses 114 and 116 (see FIG. 3), the two bumps 214 and 126 to the two small pockets 218 and 220 (see FIG. 7), and lever engagement projections 138 an 140 to engaging groove 142 and its mirrored groove (see FIG. 5). As best shown in FIG. 5, the lever 124 is initially in a first disengaged position with the lever engagement projections 138 and 140 seated upon the openings of the lever engagement grooves (again at 142). Drawing FIG. 6 shows the lever 124 being actuated over and across the top of the electrical center 78 and FIG. 1 finally shows the lever 124 fully actuated to a second and electrically engaged position in which each of the male connectors are electrically connected to the female connectors in successive fashion. Experimental analysis has shown that the mating forces, typically measured in Newtons (N), and experienced during electrical and mating engagement of the male to female connectors is significantly decreased, from a magnitude of 1530 N mating force for three fully populated connectors with threaded and torque down bolts down to approximately 55 N mating force resulting from the pivoting, diverse terminal engaging forces, and successive engagement of the mating connectors of the present invention. This invention meets automotive ergonomically standard 75 N max and eliminates cross threading and over or under torquing.

A cover 158 is engageable over said top surface of said bussed electrical center 78 and includes a top 160, a first side 162, a second side 164, a first end 166 and a second end 168. A pair 170 and 172 of hinge pins extend in laterally opposing fashion from the UHBEC 78, proximate the first end 88 and in a generally upward facing manner. The corresponding first end 166 of the cover 158 defines laterally extending engagement slots 174 and 176 defined by arcuate projections 178 and 180 configured at the first end 166 and for receiving the hinge pins 170 and 172 (or appropriately configured or singularly extending pin) to pivotally secure the cover 158 upon the bussed electrical center 78. One locking receiver 175 and locking finger 173 are located at second end 168 of cover and second end 90 of electrical center, respectively. The top cover is locked securely to the electrical center when the cover is hinged to its closed position as shown in FIG. 1. Therefore, the cover and electrical center can be shipped together.

Figure 13:
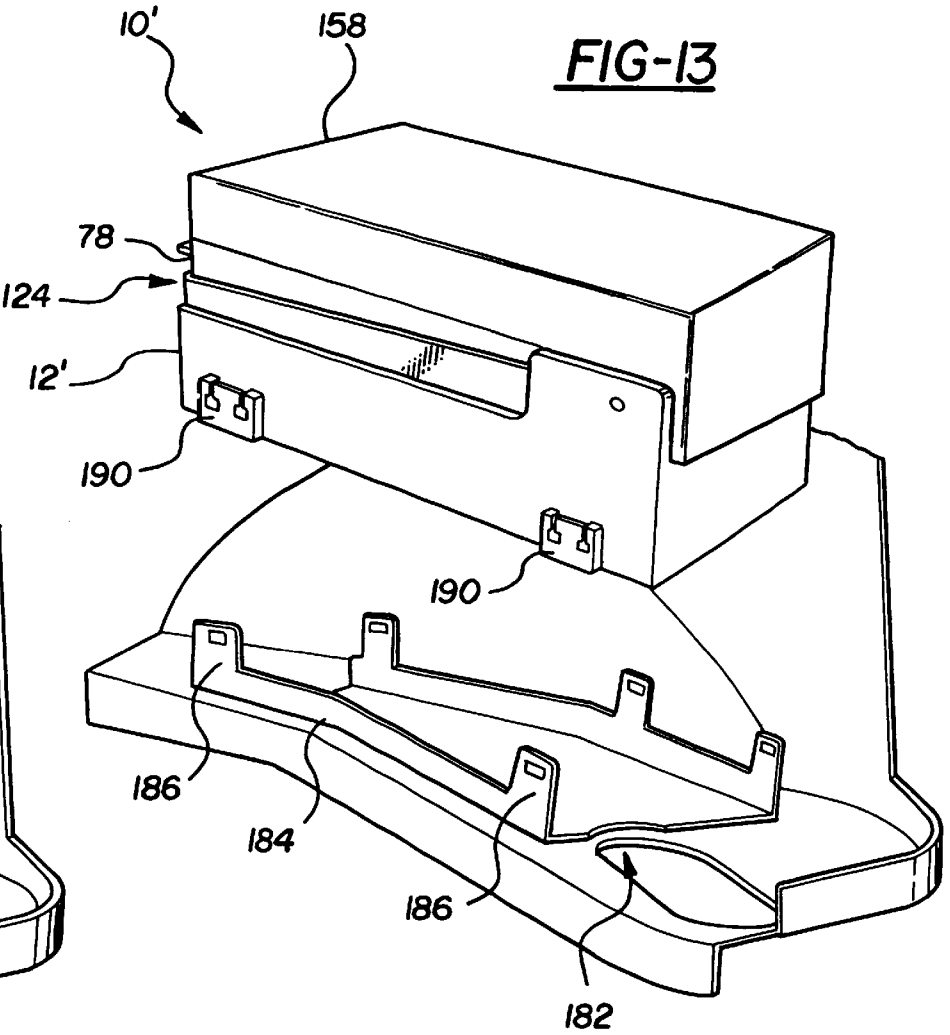
FIG. 13 is a further exploded view of the variant illustrated in FIG. 10 and further showing the upwardly extending seating posts of the fender mount engageable with the vertically extending slots formed in the sides of the tub.
Figure 12:
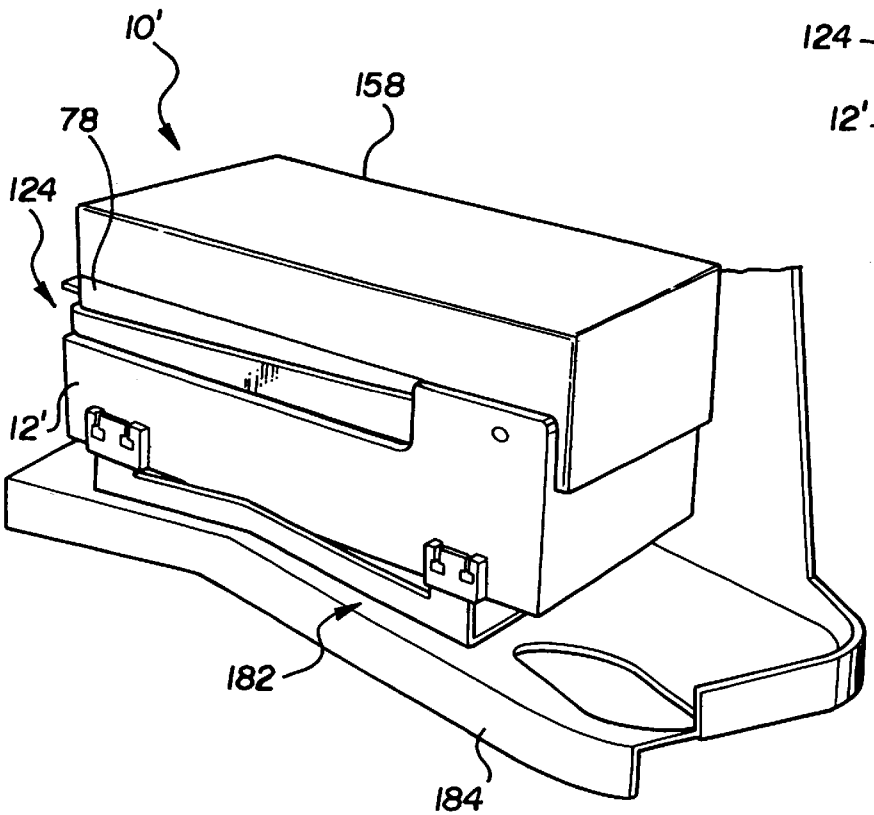
FIG. 12 is a further assembled view of a variant of the electrical coupling device, similar to that illustrated in FIG. 1, and showing the stamping mount secured to a fender shroud within the vehicle engine compartment.

Referring finally to FIGS. 12 and 13, a further variation 10' of the electrical coupling device is illustrated and which includes a substantially planar shaped stamping 182 secured to a selected location within a vehicle engine compartment, and in particular upon a fender shroud 184. The stamping 182 further includes upwardly extending seating posts, see at 186 in FIG. 13, and which engage, respectively, through a plurality of vertically extending slots 190 and arranged upon the first and second sides of a variation of the tub 12, the slots 190 being located on generally the four corners of the tub 12' and proximate its base. The slots 190 may further be established by projections extending from the specified locations of the tub 12' and so that the entire coupling assembly may be fixedly secured at the desired location. The device can be put in other various locations in similar fashion such as on an under instrument panel.

Having described our invention, it is apparent that it discloses an electrical coupling device employing a novel lever actuation mechanism, for progressively and effectively matingly securing the male connectors of the UHBEC 78 to their corresponding female connectors of the tub 12. Additional preferred embodiments will become apparent to those skilled in the art to which it pertains, and without deviating from the scope of the appended claims.

We claim:

1. An electrical coupling device, comprising:

a tub having a base, first and second sides, a first end and a second end, said sides and ends of said tub defining an upwardly facing perimeter edge surrounding an open interior;

a plurality of female connectors mounted upon said base within said open interior and arranged in an axially extending and predetermined spaced apart fashion, at least one bundle of wires communicating with said female connectors and extending from a selected location of said tub;

a bussed electrical center having a top surface, a bottom surface, first and second sides, a first end and a second end, said sides and ends of said electrical center defining a downwardly faced perimeter edge;

a plurality of male connectors constructed to said bottom surface of said bussed electrical center and arranged in an axially extending and predetermined spaced apart fashion, at least one electrical component extending from said top surface of said electrical center and electrically communicating with said male connectors;

pivotal securing means for attaching said first end of said bussed electrical center to said first end of said tub; and actuated engagement means extending from said second end of said tub and applied to said second end of said bussed electrical center for drawing each of said male connectors in successive and engaging electrical contact with each of said female connectors.

2. The electrical coupling device as described in claim 1, said pivotal securing means further comprising:

at least one inwardly facing and arcuate recess defined within and extending laterally along said first end of said tub, said arcuate recess being accessible from said upwardly facing perimeter edge;

at least one pivot pin projecting, in laterally extending fashion, from said downwardly facing perimeter edge associated with said first end of said electrical center, said pivot pin seating within said arcuate recess.

3. The electrical coupling device as described in claim 1, said actuated engagement means further comprising:

a generally "U" shaped lever having first and second legs and a centrally extending and interconnecting member;

first and second pivot projections extending in outwardly and opposite fashion from selected and aligning locations of said first and second lever legs, said pivot projections seating within correspondingly aligning apertures defined within said sides of said tub proximate said second end and said upwardly facing perimeter edge;

first and second engagement projections extending in inwardly and opposing fashion from further selected and aligning locations of said first and second lever legs; and first and second engaging grooves defined in said downwardly facing perimeter edge of said bussed electrical center, along said sides and proximate said second end;

said engagement projections seating within engaging grooves, subsequent to said pivot projections seating within said aligning apertures, and said lever being rotated from a first disengaged position over and across said top surface of said electrical center to a second and electrically engaged position.

4. The electrical coupling device as described in claim 1, further comprising individual and axially extending pockets defined within said open interior of said tub, each of said pockets mounting an associated female connector in floating fashion along at least one of first, second and third axes.

5. The electrical coupling device as described in claim 4, each of said pockets further being defined by at least one upwardly facing and chamfered edge, an associated male connector further including a likewise projecting edge aligningly engaged between said chamfered edges upon electrically engaging said male connector to said female connector.

6. The electrical coupling device as described in claim 5, each of said male connectors further comprising a subplurality of terminals, each of said female connectors further comprising a plurality of terminal insertion slots.

7. The electrical coupling device as described in claim 6, said plurality of male and female connectors further comprising first, second and third connectors.

8. The electrical coupling device as described in claim 7, said at least one bundle of wires further comprising a first, second and third bundles communicating with selected ones of said first, second and third connectors.

9. The electrical coupling device as described in claim 1, further comprising a cover engageable over said top surface of said bussed electrical center.

10. The electrical coupling device as described in claim 9, said cover further comprising a top, first and second sides, and first and second ends, at least one hinge pin extending in laterally opposing fashion from said first end of said electrical center, said first end of said cover further defining therein at least one laterally extending engagement slot for receiving said hinge pin to pivotally secure said cover upon said bussed electrical center.

11. The electrical coupling device as described in claim 1, further comprising a substantially planar shaped stamping secured to a selected location within a vehicle engine compartment or other locations such as instrument panel, said stamping further including upwardly extending seating posts which engage, respectively, through a plurality of vertically extending slots arranged upon said first and second sides of said tub proximate said base.

12. The electrical coupling device as described in claim 11, said stamping further comprising an arcuate outer configuration mounting upon a fender shroud of the vehicle compartment.

13. An electrical coupling device secured to a selected location within a vehicle engine compartment, said coupling device comprising:

a tub having a base, first and second sides, a first end and a second end, said sides and ends of said tub defining an upwardly facing perimeter edge surrounding an open interior;

a plurality of first, second and third female connectors mounted upon said base within said open interior and arranged in an axially extending and predetermined spaced apart fashion, first, second and third bundles of wires communicating with said first second and third connectors, respectively, and extending from selected locations of said tub;

a bussed electrical center having a top surface, a bottom surface, first and second sides, a first end and a second end, said sides and ends of said electrical center defining a downwardly faced perimeter edge;

a plurality of first, second and third male connectors constructed to said bottom surface of said bussed electrical center and arranged in an axially extending and predetermined spaced apart fashion, a plurality of electrical components extending from said top surface of said electrical center and electrically communicating with said male connectors;

at least one arcuately shaped recess defined within and along said first end of said tub, said bussed electrical center further including a projecting and laterally extending pin along said first end which seats within said arcuate recess; and a lever pivotally engaged with said tub proximate said second end, engagement projections extending in inwardly and opposing fashion on opposite sides of said lever and seating within aligning and engaging grooves defined in said downwardly facing perimeter edge of said electrical center;

said lever being rotated from a first disengaged position over and across said top surface of said electrical center to a second and electrically engaged position proximate said first end, each of said male connectors being drawn, upon actuation of said lever, in successive and engaging electrical contact against said female connectors.

14. An electrical coupling device, comprising:

a tub defining an upwardly facing perimeter edge surrounding an open interior;

a plurality of female connectors mounted within said open interior and arranged in an axially extending and predetermined spaced apart fashion;

a bussed electrical center defining a downwardly faced perimeter edge;

a plurality of male connectors constructed to a bottom surface of said bussed electrical center and arranged in an axially extending and predetermined spaced apart fashion;

pivotal securing means for attaching a selected end of said bussed electrical center to a selected end of said tub; and lever actuated engagement means extending from a further selected end of said tub and applied against a further selected end of said electrical center to draw each of said male connectors in successive and engaging electrical contact with each of said female connectors.

* * * * *